United States Patent [19]

Lew et al.

[11] Patent Number: 4,601,474

[45] Date of Patent: Jul. 22, 1986

[54] SELF-RETRIEVING ATTACK BALL

[76] Inventors: Hyok S. Lew; Yon K. Lew; Hyon S. Lew, all of 7890 Oak St., Arvada, Colo. 80005

[21] Appl. No.: 693,993

[22] Filed: Jan. 22, 1985

[51] Int. Cl.[4] ..... A63B 67/10

[52] U.S. Cl. ..... 273/414; 273/58 C; 273/58 K; 273/84 R; 446/249

[58] Field of Search ..... 273/84, 414, 58 C, 26 E, 273/58 K; 446/249, 250

[56] References Cited

U.S. PATENT DOCUMENTS 3,362,101 1/1968 Grow ..... 446/249

3,724,121 4/1973 Atkins et al. ..... 446/250

4,418,494 12/1983 Ghandour ..... 446/250

*Primary Examiner*—Richard C. Pinkham

*Assistant Examiner*—Matthew L. Schneider

[57] ABSTRACT

A self-defense device comprising a spherical member and a tether cord. The tether cord is wound on a self-winding spool that is rotatably attached to the interior of the spherical member. The free end of the tether cord has a loop formed thereat for securing the device to a person's wrist. The spherical member may have an outer lining of elastic material or may have a plurality of barbs on its exterior surface.

1 Claim, 4 Drawing Figures

SELF-RETRIEVING ATTACK BALL

BACKGROUND OF THE INVENTION

In medieval times, the ball and chain flail was used as an effective weapon in combat, which had proven to be a superior weapon against the sword when the user is protected with light armor. A trained base ball pitcher should be able to repulse any attacker with a weapon short of a fire arm if the base ball pitcher has a score of balls. The problem is the impracticality of carrying a score of base balls as a self-defense weapon.

The primary object of the present invention is to provide a self-defense device having the combined potency of a ball and chain flail and hundreds of base balls.

Another object is to provide a self-defense device that converts a physically capable person to a professional boxer with a six foot reach when that person is trained with this self-defense device.

A further object is to provide a self-defense device of the size and weight of a base ball that can be easily carried around by a person.

Yet another object is to provide a self-retrieving attack ball comprising a spherical shell member with a tether cord extending therefrom that automatically retracts into the spherical shell member when the tension on the tether cord is less than a preset magnitude.

Yet a further object is to provide a self-retrieving attack ball including a loop at the free-extremity of the tether cord.

Still another object is to provide a self-retrieving attack ball lined with an elastic material that makes the attack ball bounce back upon impact on a hard surface.

Still a further object is to provide a self-retrieving attack ball including a plurality of barbs affixed to the surface of the attack ball.

These and other objects of the present invention will become clear as the description thereof proceeds.

BRIEF DESCRIPTION OF FIGURES

The present invention may be described with a greater clarity and specificity by referring to the following figures.

DESCRIPTION OF THE ILLUSTRATED EMBODIMENTS

Figure 1:
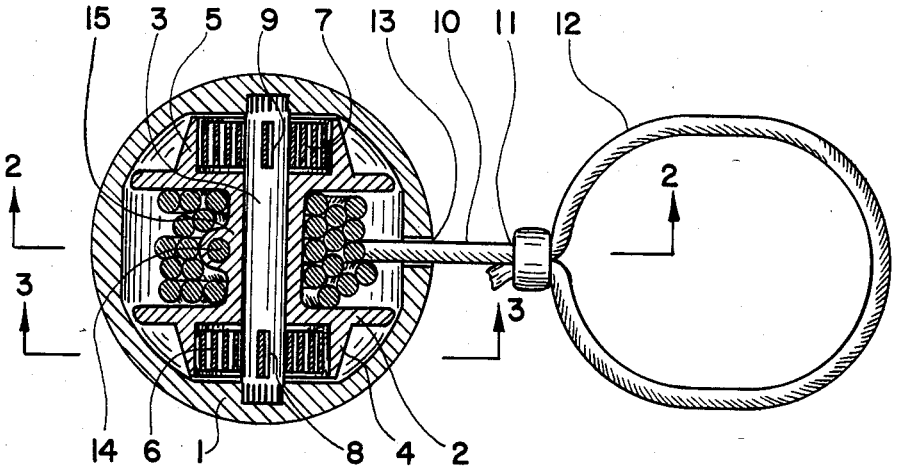
FIG. 1 illustrates a cross seciton of a self-retrieving attack ball constructed in accordance with the principles of the present invention.

In FIG. 1 there is shown a cross section of a self-retrieving attack ball constructed in accordance with the principles of the present invention, which cross section is taken along a plane including the center of the spherical shell 1. A spool 2 rotatable about a shaft 3 is disposed within the spherical shell 1. The shaft 3 with the central axis substantially passing through the center of the spherical shell 1 is rigidly secured to the spherical shell as two extremities thereof are rigidly anchored to the spherical shell 1. Two cylindrical flanges 4 and 5 respectively extending from two ends of the spool 2 house two spiral springs 6 and 7, respectively, wherein the inner extremities of two spiral springs 6 and 7 are respectively anchored in two slots 8 and 9 included in the shaft 3, while the outer extremities are respectively secured to two flanges 4 and 5. A cord 10 is wound on the spool 2 wherein one extremity 11 of the cord 10 slidably engages and extends through a hole 13 disposed through the wall of the spherical shell 1, which extremity of the cord includes a loop 12. The other extremity 14 of the cord 10 is anchored to the hub of the spool 2.

Figure 2:
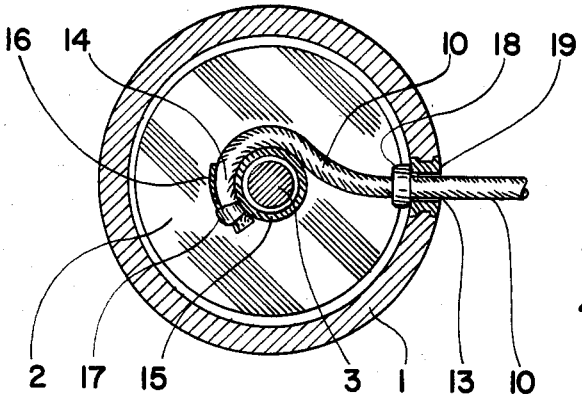
FIG. 2 illustrates another cross section of the attack ball shown in FIG. 1.

In FIG. 2 there is shown another cross section of the self-retrieving attack ball shown in FIG. 1, which cross section is taken along a plane 2—2 as shown in FIG. 1. In this illustration, the cord 10 is fully extended from the attack ball and, consequently, the cord 10 is unwound from the spool 2. The inner extremity 14 of the cord 10 is routed through an anchoring hole 16 built into the hub 15 of the spool 2 and is anchored thereto by means of a stop 17 clamped onto the inner end of the cord 10. As an option, a cord stop 18 clamped on the cord at a short destance from the inner extremity 14 of the cord 10 may be included in order to avoid an excessive amount of pull on the spool hub. Of course, when the structure of spool assembly is sufficiently strong and the inner extremity 14 of the cord 10 is securely anchored thereto, it is not necessary to include the cord stop 18. The hole 13 through the wall of the spherical shell 1 may be reinforced with an insert 19, if the spherical shell 1 is made of a material that is weak against abrasion. When the spherical shell 1 is made of a strong material, the inclusion of the insert 19 is not required.

Figure 3:
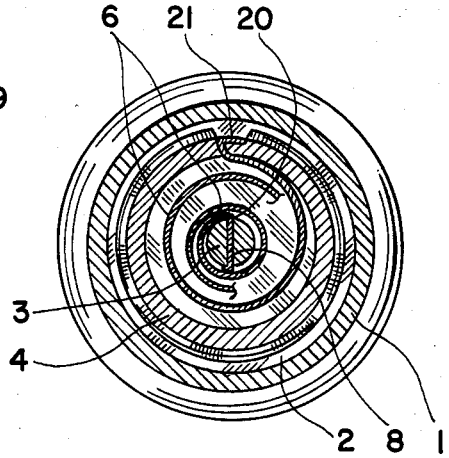
FIG. 3 illustrates a further cross section of the attack ball shown in FIG. 1.

In FIG. 3 there is illustrated a further cross section of the self-retrieving attack ball shown in FIG. 1, which cross section is taken along plane 3—3 as shown in FIG. 1. Here the arrangement of the spiral spring 6 is further illustrated. The inner extremity 20 of the spiral spring 6 is anchored in the slot 8 included in the shaft 3 that is immovably secured to the spherical shell 1, while the outer extremity 21 of the spiral spring 6 is secured to the flange 4 rigidly affixed to the spool 2. The other spiral spring 7 is also arranged in the same fashion as that of the spiral spring 6.

Figure 4:
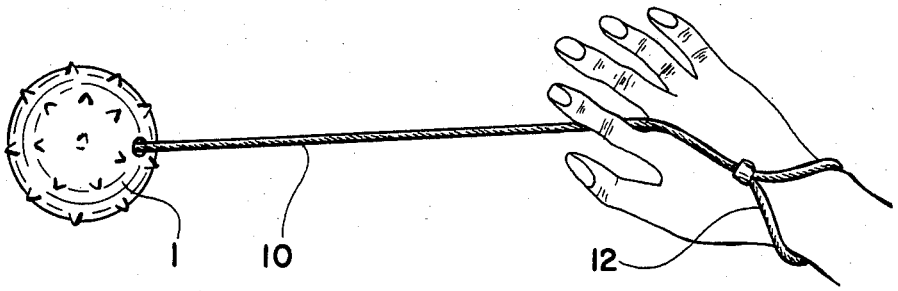
FIG. 4 illustrates an attack ball handled by a user wherein the loop structure included in the free-end of the tether cord is secured to the wrist of the handler.

In FIG. 4 there is shown a perspective view of a self-retrieving attack ball similar to that illustrated in FIGS. 1, 2 and 3, that is tethered to the wrist of a user. The combined rewinding torque provided by the pair of the spiral springs 6 and 7 is large enough to rewind the cord 10 onto the spool 2 against the weight of the attack ball, while it is small enough to allow a transfer of a large impact momentum to the attack ball from the arm of the user when the attack ball is pitched like a base ball thrown by the pitcher or when the attack ball is swung like a flail. When the impact momentum imparted on the attack ball is consumed upon impacting on a target or by the pulling action by the user, the cord 10 automatically retracts into the spherical shell 1 by the spring loaded rewinding action of the spool and, consequently, the attack ball is automatically retrieved back into the palm of the user. The surface of the attack ball may be provided with a plurality of protrusions such as spikes or barbs as shown in FIG. 4 in order to increase the potency of its impact or it may be lined with a resilient elastic material in order to decrease the potency of its impact as well as to obtain a greater bouncing effect. It is quite clear that the self-retrieving attack ball may be used as a self-defense device as well as a recreational device. For example it may be used as a fake yo-yo when the external configuration of the closed shell member, that is the spherical shell, is made to resemble a yo-yo. The attack ball may be used in practicing pitching or as a physical training device.

While the principles of the present invention have now been made clear by the illustrative embodiments, it will be obvious to those skilled in the art many modifications of the structures, arrangements, proportion, elements and materials which are particularly adapted to the specific working environments and operating conditions in the practice of the invention without departing from those principles.

We claim:

1. A self-retrieving attack ball comprising in combination: a closed shell member including a hole through the wall of said closed shell member; a self-rewinding spool rotatably disposed within said closed shell member; a cord slidably engaging and extending through said hole through the wall of said closed shell member wherein one extremity of said cord is anchored to said self-rewinding spool and the other extremity includes means for stopping said other extremity of said cord from retracting into the inside of said closed shell member, said means comprising a loop mmeber; and the outer surface of said closed shell member including a plurality of protrusions; whereby, said self-retrieving attack ball automatically returns to the palm of the user after said self-retrieving attack ball is thrown by the user when said other extremity of said cord is secured to the user's hand.

* * * * *